US007041148B2

(12) United States Patent
Iorio et al.

(10) Patent No.: US 7,041,148 B2
(45) Date of Patent: May 9, 2006

(54) COATED FERROMAGNETIC PARTICLES AND COMPOSITIONS CONTAINING THE SAME

(75) Inventors: Luana Emiliana Iorio, Clifton Park, NY (US); Paul Alfred Siemers, Clifton Park, NY (US); Gerald Burt Kliman, Niskayuna, NY (US); Krishnamurthy Anand, Bangalore, IN (US); Amitabh Verma, Bangalore, IN (US)

(73) Assignee: General Electric Company, Niskayuna, NY (US)

( * ) Notice: Subject to any disclaimer, the term of this patent is extended or adjusted under 35 U.S.C. 154(b) by 125 days.

(21) Appl. No.: 10/376,643

(22) Filed: Mar. 3, 2003

(65) Prior Publication Data

US 2004/0173287 A1 Sep. 9, 2004

(51) Int. Cl.
*C22C 29/14* (2006.01)
*H01F 1/22* (2006.01)

(52) U.S. Cl. ..... 75/245; 75/244; 148/306; 148/307; 148/308; 148/104; 428/403; 428/407; 428/570

(58) Field of Classification Search ..... 428/403, 428/407, 570; 148/104, 306, 307, 308; 75/234, 75/246

See application file for complete search history.

(56) References Cited

U.S. PATENT DOCUMENTS

| | | | | |
|---|---|---|---|---|
| 4,601,765 | A | 7/1986 | Soileau et al. | |
| 5,151,206 | A * | 9/1992 | Okamura et al. | 252/62.51 R |
| 5,352,522 | A | 10/1994 | Kugimiya et al. | |
| 5,595,609 | A | 1/1997 | Gay | |
| 5,754,936 | A | 5/1998 | Jansson | |
| 6,102,980 | A * | 8/2000 | Endo et al. | 75/252 |
| 6,149,704 | A * | 11/2000 | Moro et al. | 75/230 |
| 6,527,823 | B1 * | 3/2003 | Moro | 75/246 |
| 2002/0014280 | A1 * | 2/2002 | Moro | 148/104 |
| 2002/0023693 | A1 | 2/2002 | Lefabvre et al. | |
| 2004/0174239 | A1 * | 9/2004 | Shibata et al. | 336/83 |

OTHER PUBLICATIONS

"Coated Ferromagnetic Particles and Composite Magnetic Articles Thereof," Anand et al., U.S. Appl. No. 10/064,152, filed Jun. 14, 2002.

* cited by examiner

*Primary Examiner*—John P. Sheehan
(74) *Attorney, Agent, or Firm*—Fletcher Yoder

(57) ABSTRACT

High-permeability, low-core-loss soft magnetic composite materials, compositions containing the same, and methods for making the same are described. These magnetic materials are made by forming fiber or flake shaped particles from a ferromagnetic material, annealing the particles, and then coating an insulating material on the particles. These particles can then be compacted to form an article that has high permeability, high saturation, low core loss, and is a suitable replacement for laminations in various applications, such as motors.

11 Claims, 2 Drawing Sheets

COATED FERROMAGNETIC PARTICLES AND COMPOSITIONS CONTAINING THE SAME

BACKGROUND OF THE INVENTION

This invention generally relates to composite materials. More particularly, this invention relates to insulated magnetic particles. Even more particularly, this invention is related to electrically insulating coatings on ferromagnetic particles and compositions containing such coated ferromagnetic particles.

Magnetic materials fall generally into two categories: hard magnetic materials (that may be permanently magnetized) and soft magnetic materials (whose magnetization can be reversed). Iron-based magnetic (ferromagnetic) powders are often used as a component in soft magnetic materials.

Magnetic permeability and core loss are important characterizing properties of soft magnetic materials. Magnetic permeability measures the ease with which a magnetic substance may be magnetized and indicates the ability of the material to carry magnetic flux. Core loss measures the energy loss when a magnetic device is exposed to a time varying field. Core loss can be divided into two main categories: hysteresis loss and eddy current loss. Hysteresis loss measures the energy needed to overcome the retained magnetic forces in the magnetic core. Eddy current loss results from the flow of electric currents within the magnetic core induced by the changing magnetic flux.

Many electromagnetic devices contain a soft magnetic material made from laminated structures. Laminated structures typically comprise stacked thin sheets which are oriented parallel to the expected magnetic field. The sheets may often be coated to provide insulation and prevent current from circulating between the sheets. Unfortunately, the thicker this insulation layer, the lower the laminate stacking factor will be. And low stacking factors can result in reduced average magnetic permeability in the structure. As well, fabricating three-dimensional articles using laminated structures can be expensive and complex. Further, laminated structures experience large core losses at higher frequencies and can be acoustically noisy as the laminated sheets often vibrate.

Sintered or coated ferromagnetic powders have been proposed as an alternative for laminated structures in magnetic devices (or articles). These ferromagnetic powders generally allow greater variation in the geometry and avoid the manufacturing burdens resulting from laminated structures. However, articles made with sintered ferromagnetic powders exhibit high core losses and typically have restricted end-uses. Using coated ferromagnetic powders in articles, however, is a more viable alternative. The coating provides an electrical insulation for the individual ferromagnetic particles and can reduce eddy current losses. The coating can also serve as a binder or a molding lubricant in certain instances.

Various methods have been used to make magnetic articles containing coated ferromagnetic powders, including different types of coating materials and coating methods. Inorganic coating materials such as iron phosphate, iron chromate, iron oxides and boron nitride have been used. Similarly, organic coating materials have been used. Double-coated ferromagnetic powders have also been used. Polymeric materials such as polyamides, polyimides and polysulfones have been used as one coating material for ferromagnetic powders. The polymeric coating not only insulates the powder particles from one another, but also can help bind the particles together during compaction when making the magnetic article.

The magnetic properties of magnetic articles containing polymeric-coated ferromagnetic materials, however, do not allow widespread use of these materials. In particular, these materials suffer from low temperature properties of polymers that limit the high temperature annealing process that can be carried out. Instead, low-temperature annealing processes must be used that are not able to remove the cold work resulting from compaction fully, adversely affecting the permeability and losses of the magnetic articles.

BRIEF SUMMARY OF THE INVENTION

The invention relates to high-permeability, low-core-loss soft magnetic composite materials, compositions containing the same, and methods for making the same. These magnetic materials are made by forming fiber or flake shaped particles from a ferromagnetic material, annealing the particles, and then coating an insulating material on the particles. These particles can then be compacted to form an article that has high permeability, high saturation flux density, low core loss, and is a suitable replacement for laminations in various applications, such as motors.

The invention includes a method for making a material by converting a ferromagnetic material into high-aspect ratio ferromagnetic particles, providing a coating on the particles, the coating comprising an insulating material, and then compacting the coated particles. The invention also includes a method for making a material by converting a ferromagnetic material with a grain-oriented structure into high-aspect ratio ferromagnetic particles, providing an insulating coating on the particles, the coating comprising silicone, and then compacting the coated particles. The invention yet further includes a method for making a magnetic article by converting a ferromagnetic material into high-aspect ratio ferromagnetic particles, providing a coating on the particles, the coating comprising an insulating material, and then compacting the coated particles. The invention still further includes a method for making a magnetic article by converting a ferromagnetic material with a grain-oriented structure into high-aspect ratio ferromagnetic particles, providing an insulating coating on the particles, the coating comprising silicone, and then compacting the coated particles. The invention also includes magnetic materials made by such methods.

The invention also embraces a magnetic material comprising a plurality of ferromagnetic particles having a shape substantially similar to a flake or a fiber and having an aspect ratio ranging from about 3 to about 100, and an insulating coating on the particles. The invention further embraces a magnetic material comprising a plurality of aligned ferromagnetic particles having a shape substantially similar to a flake or a fiber and having an aspect ratio ranging from about 3 to about 100, and an insulating coating comprising silicone on the particles. The invention also includes devices containing such magnetic materials.

BRIEF DESCRIPTION OF THE DRAWINGS

FIGS. 1–2 are views of one aspect of the coated ferromagnetic particles and methods of making such particles according to the invention, in which:

FIG. 1 illustrates a method for making a magnetic material in one aspect of the invention; and FIG. 2 depicts possible geometries of the particles used in the magnetic materials in one aspect of the invention.

FIG. 1, presented in conjunction with this description, depicts only particular-rather than complete-portions of the coated ferromagnetic particles and methods of making such particles in one aspect of the invention. Together with the following description, the Figure demonstrates and explains the principles of the invention.

DETAILED DESCRIPTION OF THE INVENTION

The following description provides specific details in order to provide a thorough understanding of the invention. The skilled artisan, however, would understand that the invention can be practiced without employing these specific details. Indeed, the present invention can be practiced by modifying the illustrated system and method and can be used in conjunction with apparatus and techniques conventionally used in the industry.

The invention generally pertains to insulating coatings on ferromagnetic particles. Such coatings can be made by any process that provides an electrically insulating, yet thermally stable coating for ferromagnetic particles. In one aspect of the invention, the process described below is used to obtain such coatings.

Figure 1:
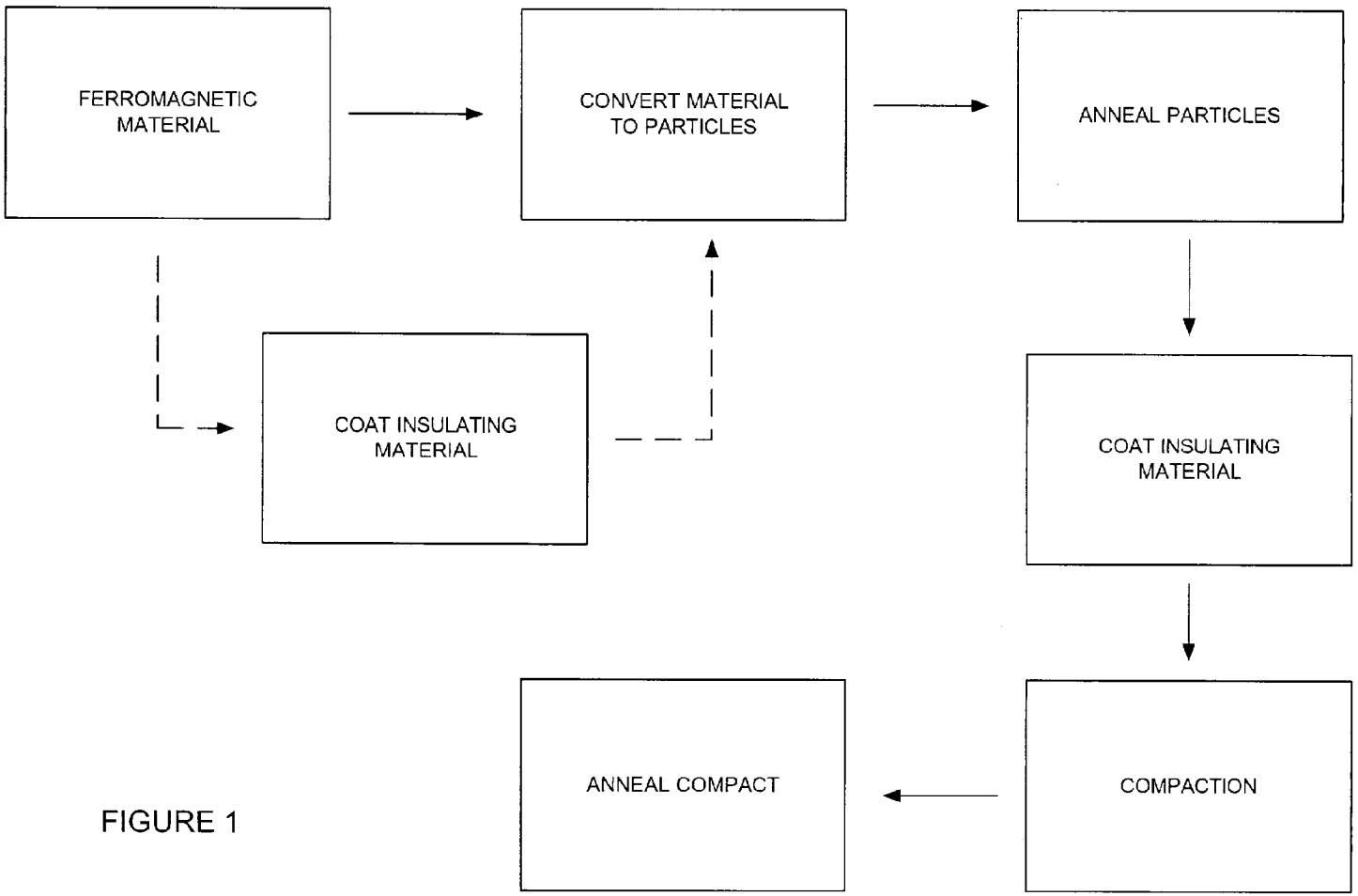
Figure 2:
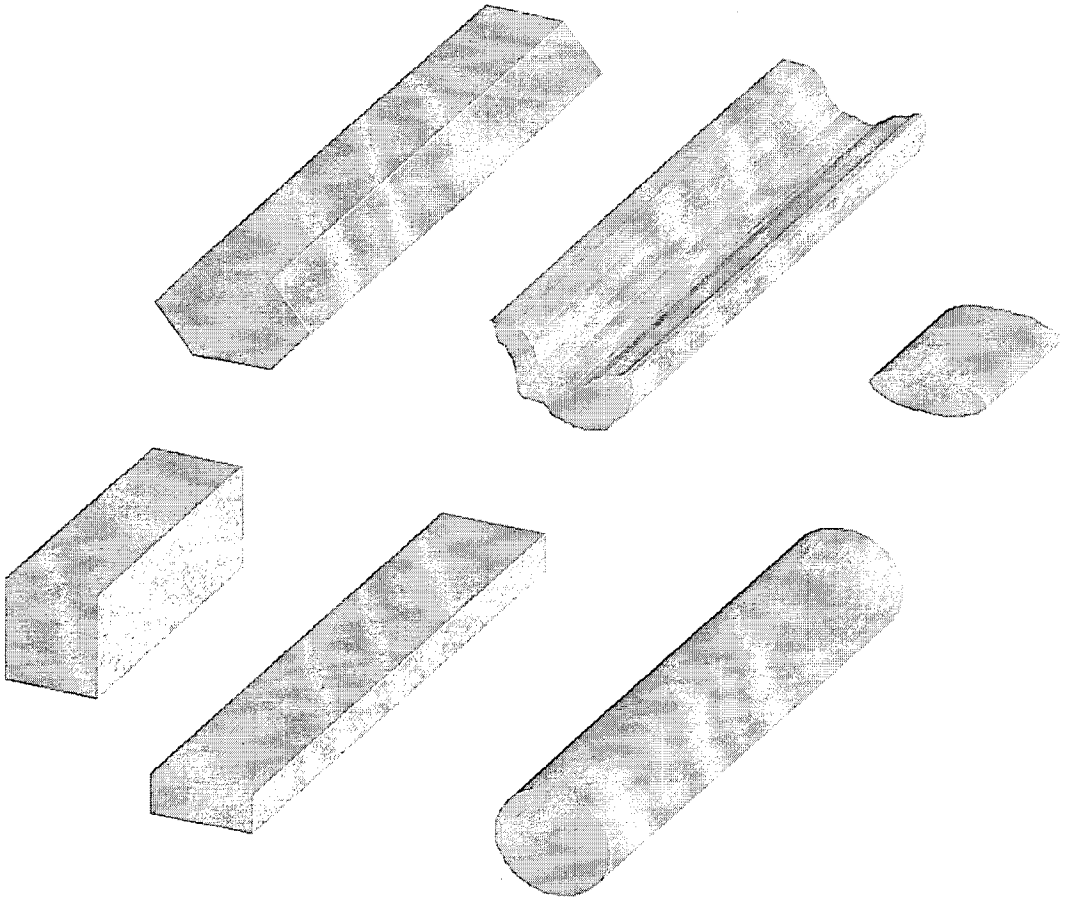

As depicted in FIG. 1, the process begins by providing a ferromagnetic material. The ferromagnetic material can be any iron-containing material having a low yield strength. Examples of ferromagnetic materials include high purity iron, as well as Fe alloys containing Si, Al, Ni, Co, P, and/or B. The choice of the specific element(s) to include in the alloy depends on the desired mechanical, electrical, and magnetic properties. In one aspect of the invention, pure iron is used as the ferromagnetic material.

The texture of the ferromagnetic starting material is important because the magnetic properties are dependent on the crystallographic orientation of the grains within the ferromagnetic material. Thus, any texture that meets such criteria can be used in the invention. Examples of such textures include grain-oriented structures such as wires and sheets. In one aspect of the invention, the texture is rolled Fe—Si steel which has the preferred <100> crystallographic direction in the direction of rolling.

The ferromagnetic material is then cleaned using any known process, if necessary. In one aspect of the invention, the ferromagnetic material is cleaned with acetone and dilute sulphuric acid to de-grease and de-scale the material, respectively. The material is then washed with warm water to remove the traces of acids.

In one aspect of the invention, and as shown by the dotted lines in FIG. 1, the ferromagnetic material can be provided with an insulating coating at this stage. The insulating material for the coating can be any known electrically insulating material such as metal oxides, phosphates, or organic resins. The insulating coating can be applied by any known technique. For example, where the ferromagnetic material is in the form of a sheet (or a wire), an insulating coating can be applied to the sheet (or wire) as part of the processing of the sheet (or the wire).

The ferromagnetic material is then converted or fabricated into particles having a shape with a high aspect ratio. Examples of such shapes include flakes and acicular (needle or fiber shaped) particles. The cross-sectional shape of the ferromagnetic particle can be substantially rectangular, polygonal, or circular. The aspect ratio of the particles can range from about 3 to about 100. In one aspect of the invention, the aspect ratio can range from about 5 to about 50. Generally, the average aspect ratio of the particles ranges from about 3 to about 100. In one aspect of the invention, the average aspect ratio can be about 40.

In one aspect of the invention, the ferromagnetic particles are formed with dimensions consistent with the shapes described above. For example, the average length of the particles can range from about 3 to about 25 mm, the average width of the particles could range from about 0.1 to about 0.7 mm, and the average thickness of the particles could range from about 0.02 to about 0.7 mm. In another aspect of the invention, the absolute length of the particles can range from about 0.5 to about 25 mm, the absolute width of the particles could range from about 0.02 to about 2 mm, and the absolute thickness of the particles could range from about 0.01 to about 2 mm.

The ferromagnetic material can be formed into particles by any process that forms the above shapes and sizes. For example, where the ferromagnetic material is a solid material, it could be rolled into sheets and the sheets could be slit. In another example, where the ferromagnetic material is a wire, it can be rolled to deform the wire and reduce the cross-section of the wire from a round shape to a flat shape. The flattened wire can then be cut into flakes with the desired dimensions as indicated above. In another aspect of the invention, the ferromagnetic particles could be made from molten ferromagnetic material The individual particles can then optionally be annealed, thereby improving the compactibility and the magnetic properties of the material. Any annealing process for achieving this result can be used in the invention. In one aspect of the invention, the particles are annealed at about 600 to about 1200 degrees Celsius for about 15 to about 120 minutes. In another aspect of the invention, the particles are annealed at a temperature of about 800 degrees Celsius for about 60 minutes. The annealing process can be performed in any protective atmosphere, e.g., argon, nitrogen, or hydrogen. In one aspect of the invention, the annealing process can be a "decarb" annealing process that is performed under a standard decarburizing atmosphere to reduce the carbon content in the particulates to less than about 0.05 wt %. In one aspect of the invention, the decarb annealing process can reduce the carbon content to than 0.009%.

Where the ferromagnetic material has not been provided with an insulating coating as described above, the annealed ferromagnetic particles are then coated with an insulating material. If the ferromagnetic material has been provided with an insulating coating as described above, the annealed ferromagnetic particles can still then coated with an insulating material because in the process of converting the ferromagnetic material to particles, some portions of the particles will not remain insulated.

In one aspect of the invention, the particles can be coated as an in-situ process, e.g., as a part of the process of making the particles. In another aspect of the invention, the particles are coated after they have been formed. In yet another aspect of the invention, the particles can be coated using both processes.

The insulating material for the coating can be any of those materials described above. In one aspect of the invention, the insulating material comprises silicone. The thickness of the coating need only be sufficient to provide the desired insulation, as well as act as a binder if necessary. Typically, the coating has a thickness ranging from about 0.01 to about 2 micrometers. In one aspect of the invention, the coating has a thickness ranging from about 0.01 to about 0.5 micrometers.

The insulating coating provides electrical insulation for the individual ferromagnetic particles and, therefore, a better coating coverage results in lower eddy current losses. The weight fraction of the insulating material in the coated ferromagnetic particle also affects the permeability as well as the core loss characteristics. Typically, the weight fraction of the insulating material in the coated ferromagnetic particle ranges from about 0.001 to about 2 wt %. In one aspect of the invention, this weight fraction of the coating material ranges from about 0.05 to about 1 wt %.

The insulating material can be coated on the particles using any coating process, such as spraying, vapor deposition, dipping, fluidized bed coating, precipitation coating, or a combination thereof. Where the insulating material is a metal oxide, the coating can be formed by applying a metal film to the ferromagnetic particle and then oxidizing the metal film to make a metal oxide. Where the insulating material is silicone, it can be dissolved in xylene solvent to make a silicone solution and then the particles are dipped in the solution. The solvent is evaporated off by application of vacuum and/or heat, leaving a silicone coating on the particles.

After being coated, the particles are then compacted into any desired shape and size using any known compaction process. Suitable compaction techniques include uniaxial compaction, isostatic compaction, injection molding, extrusion, and hot isostatic pressing. In one aspect of the invention, the particles are compacted using a process that aligns the high-aspect ratio particles. The particles are aligned in order to improve the magnetic properties in the direction of the particle alignment. In one aspect of the invention, the compaction process is carried out while vibrating the particles to obtain this alignment. Another alignment technique is to apply a magnetic field just prior to or during compaction. Yet another alignment technique is aerating The compaction process is usually carried out at room temperature and at a sufficient pressure to compact to the desired density without inducing excessive residual stresses. Typically, the pressure can range from about 60 to about 200 ksi. In one aspect of the invention, the compaction pressure is about 177 ksi. The compaction process generally yields compacts having at least about a 90% relative density. In one aspect of the invention, the compacts have a relative density of about 90% to about 96%.

If desired, the compacted powders can then be annealed. The compacted shapes are annealed to remove the stresses introduced during compaction, thereby achieving a higher permeability and a lower hysteresis loss. The annealing process can be carried out under any conditions that will remove the stress from compaction. In one aspect of the invention, the compacted shapes are annealed at about 300 to about 800 degrees Celsius for about 10 to about 120 minutes. In another aspect of the invention, the compacts are annealed at a temperature ranging from about 500 to about 600 degrees Celsius for about 10 to about 30 minutes. The annealing process can be performed in any protective atmosphere, e.g., argon or nitrogen.

The resulting magnetic articles containing the compacted and coated ferromagnetic particles of the invention can be used in the manufacture of numerous devices as known in the art. Examples of devices include stators, rotors, solenoids, transformer cores, inductors, actuators, MRI pole faces, and MRI shims. See also, for example, U.S. Pat. Nos. 4,601,765, 5,352,522, 5,595,609, and 5,754,936, as well as U.S. Patent Publication No. US20020023693 A1.

The following non-limiting examples illustrate the invention.

EXAMPLE 1

Several samples of soft magnetic composite materials were made with the aspect ratios and cross-sectional areas as shown in Table 1. High purity iron was used as the starting material to make the particles. The particles were annealed at 800° C. for one hour and then coated with a silicone coating using a rotovac process. The nominal coating content was kept constant for all samples.

The coated particles were then compacted into a ring for magnetic property measurements. A compaction pressure of 177 ksi was used for all samples. After compaction, the samples were all annealed for 30 minutes at 700° C. in a nitrogen atmosphere. A secondary heat treatment of 500° C. for 30 minutes was subsequently applied. The magnetic properties of the samples were then measured.

TABLE 1

Magnetic Properties at 60 Hz and 1.0 T of SMC materials

| Width (mm) | Length (mm) | Cross-Section | Permeability | Core Loss (W/lb) |
|---|---|---|---|---|
| 0.1 | 3 | Round | 1070 | 4.5 |
| 0.1 | 10 | Rectangular | 1280 | 4.2 |
| 0.3 | 3 | Rectangular | 1140 | 5.6 |
| 0.3 | 10 | Round | 2270 | 2.2 |
| 0.5 | 3 | Rectangular | 1660 | 1.9 |
| 0.5 | 10 | Round | 2290 | 2.2 |

Having described these aspects of the invention, it is understood that the invention defined by the appended claims is not to be limited by particular details set forth in the above description, as many apparent variations thereof are possible without departing from the spirit or scope thereof.

What is claimed is:

1. A magnetic material made by the method comprising:

converting a ferromagnetic material into ferromagnetic particles having an aspect ratio ranging from about 3 to about 100, wherein the length of the ferromagnetic particles ranges from about 0.5 to about 25 mm, the width of the ferromagnetic particles ranges from about 0.02 to about 2 mm, and the thickness of the ferromagnetic particles ranges from about 0.01 to about 2 mm;

providing a coating on the ferromagnetic particles, the coating comprising an insulating material;

vibrating the coated particles to align the coated particles; and compacting the aligned coated particles.

2. A magnetic material made by the method comprising:

converting a ferromagnetic material with a grain-oriented structure into ferromagnetic particles having an aspect ratio ranging from about 3 to about 100, wherein the length of the ferromagnetic particles ranges from about 0.5 to about 25 mm, the width of the ferromagnetic particles ranges from about 0.02 to about 2 mm, and the thickness of the ferromagnetic particles ranges from about 0.01 to about 2 mm;

providing an insulating coating on the ferromagnetic particles, the coating comprising silicone, wherein the length of the ferromagnetic particles ranges from about 0.5 to about 25 mm, the width of the ferromagnetic particles ranges from about 0.02 to about 2 mm, and the thickness of the ferromagnetic particles ranges from about 0.01 to about 2 mm;

aligning the ferromagnetic particles; and compacting the aligned coated particles.

3. A magnetic material, comprising:

a plurality of flake or fiber shaped ferromagnetic particles having an aspect ratio ranging from about 3 to about 100, wherein the length of the ferromagnetic particles ranges from about 0.5 to about 25 mm, the width of the ferromagnetic particles ranges from about 0.02 to about 2 mm. and the thickness of the ferromagnetic particles ranges from about 0.01 to about 2 mm; and an insulating coating on the ferromagnetic particles.

4. The material of claim 3, wherein the aspect ratio ranges from about 5 to about 50.

5. The material of claim 3, wherein the length of the ferromagnetic particles ranges from about 3 to about 25 mm, the width of the ferromagnetic particles ranges from about 0.1 to about 0.7 mm, and the thickness of the ferromagnetic particles ranges from about 0.02 to about 0.7 mm.

6. The material of claim 3, wherein the ferromagnetic particles are aligned.

7. A magnetic material, comprising:

a plurality of flake or fiber shaped aligned ferromagnetic particles having an aspect ratio ranging from about 3 to about 100, wherein the length of the ferromagnetic particles ranges from about 0.5 to about 25 mm, the width of the ferromagnetic particles ranges from about 0.02 to about 2 mm, and the thickness of the ferromagnetic particles ranges from about 0.01 to about 2 mm; and an insulating coating comprising silicone on the ferromagnetic particles.

8. A device containing a magnetic material, the material comprising:

a plurality of flake or fiber shaped ferromagnetic particles having an aspect ratio ranging from about 3 to about 100, wherein the length of the ferromagnetic particles ranges from about 0.5 to about 25 mm, the width of the ferromagnetic particles ranges from about 0.02 to about 2 mm, and the thickness of the ferromagnetic particles ranges from about 0.01 to about 2 mm; and an insulating coating on the ferromagnetic particles.

9. A device containing a magnetic material, the material comprising:

a plurality of flake or fiber shaped aligned ferromagnetic particles having an aspect ratio ranging from about 3 to about 100, wherein the length of the ferromagnetic particles ranges from about 0.5 to about 25 mm,. the width of the ferromagnetic particles ranges from about 0.02 to about 2 mm, and the thickness of the ferromagnetic particles ranges from about 0.01 to about 2 mm; and an insulating coating comprising silicone on the ferromagnetic particles.

10. A magnetic material, comprising:

a plurality of flake or fiber shaped ferromagnetic particles having an aspect ratio ranging from about 3 to about 100, wherein the length of the ferromagnetic particles ranges from about 3 to about 25 mm, the width of the ferromagnetic particles ranges from about 0.1 to about 0.7 mm, and the thickness of the ferromagnetic particles ranges from about 0.02 to about 0.7 mm; and an insulating coating on the ferromagnetic particles.

11. A magnetic material made by the method comprising:

converting a ferromagnetic material into ferromagnetic particles having an aspect ratio ranging from about 3 to about 100, wherein the length of the ferromagnetic particles ranges from about 0.5 to about 25 mm, the width of the ferromagnetic particles ranges from about 0.02 to about 2 mm, and the thickness of the ferromagnetic particles ranges from about 0.01 to about 2 mm;

providing a coating on the ferromagnetic particles, the coating comprising an insulating material;

applying a magnetic field to align the ferromagnetic particles; and compacting the aligned coated particles.

* * * * *